US006637467B2

(12) United States Patent
Piccinino, Jr. et al.

(10) Patent No.: US 6,637,467 B2
(45) Date of Patent: Oct. 28, 2003

(54) SUPPORT FRAME FOR A PROCESSING SOLUTION CONTAINER PACKAGE

(75) Inventors: Ralph L. Piccinino, Jr., Rush, NY (US); Kevin H. Blakely, Rochester, NY (US); Craig S. Lefevre, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/263,173

(22) Filed: Oct. 2, 2002

(65) Prior Publication Data

US 2003/0047234 A1 Mar. 13, 2003

Related U.S. Application Data

(62) Division of application No. 09/848,066, filed on May 3, 2001, now Pat. No. 6,505,655.

(51) Int. Cl.[7] ..... B65B 3/04

(52) U.S. Cl. ..... 141/2; 141/114; 141/314; 141/364; 141/366

(58) Field of Search ..... 141/1, 2, 312–316, 141/319, 114, 363–366, 383–386, 390, 391; 206/521, 526, 588, 589, 592; 222/144.5, 160, 164, 167, 212, 214, 389, 394

(56) References Cited

U.S. PATENT DOCUMENTS 5,488,447 A 1/1996 Patton et al.
5,577,614 A 11/1996 Palmeroni, Jr. et al.
5,694,991 A 12/1997 Harris et al.
5,753,111 A 5/1998 Patton et al.
5,878,798 A 3/1999 Harris et al.
5,996,653 A 12/1999 Piccinino, Jr.
6,012,606 A 1/2000 Harris et al.
6,041,966 A 3/2000 Piccinino, Jr. et al.
6,079,444 A 6/2000 Harris et al.
6,505,655 B2 * 1/2003 Piccinino et al. ..... 141/2

* cited by examiner

*Primary Examiner*—Timothy L. Maust
(74) *Attorney, Agent, or Firm*—David A. Novais

(57) ABSTRACT

A processing solution container package system includes a frame that supports the containers of the package system and allows each of the containers to collapse while avoiding a trapping of solution within the containers. The frame comprises first and second members that include interlocking sections to permit each of the members to be accommodated on the surface of the containers and interlocked to each other. The frame includes curved sections to support a valve neck of each of the containers in an extended non-collapsed position. This helps in the assembly of the containers, and further prevents the valve necks of the containers from collapsing back towards the top surface of the containers while the containers are being filled with solution. Also, the frame that supports the containers prevents damage to the containers if the containers are accidentally dropped. In a further feature of the invention, the containers have a crown shaped surface which corresponds to a curved surface of the frame. The crown shaped surface of the containers maintain their shape during drainage to avoid the trapping of solution within the container and promote a drainage of essentially all the solution in the container.

4 Claims, 6 Drawing Sheets

SUPPORT FRAME FOR A PROCESSING SOLUTION CONTAINER PACKAGE

CROSS-REFERENCE TO RELATED APPLICATION

This is a Divisional of Application No. U.S. Ser. No. 09/848,066 filed May 3, 2001, now U.S. Pat. No. 6,505,655.

FIELD OF THE INVENTION

The present invention relates to a support frame for a processing solution container package, and more specifically, a frame having interlocking members that is used to support processing solution containers while at the same time facilitating drainage of solution from the container to an associated processor. The present invention further relates to a processing solution container package system including the frame and at least one solution container.

BACKGROUND OF THE INVENTION

Processing solution containers in which processing solution is drained from the bottom of the container to an associated processor are known. In one embodiment of these bottom draining containers, the container is flexible so as to collapse as solution is drained. In current designs, the bottom surface of these bottom draining containers usually define a flat surface so that as the solution drains and the container collapses, an inside surface or portion of the flat bottom surface of the container tends to crease and form pockets that tend to hold or trap solution. This therefore prevents or hinders complete drainage of the solution from the container to the associated processor.

In the field of processing photographic material, it is preferable that a substantial amount of solution is drained from the container. However, in the containers described above, this is prevented or inhibited due to the solution being trapped in the creases or folds of the collapsing container, thereby leaving unwanted solution within the container when the container is transported after use or removed for replacement with another container.

A further drawback with conventional containers is that the valve neck of the solution container is not adequately supported. Therefore, during a filling operation, the valve neck tends to collapse from an extended state or operating position back into the container thereby making it more difficult to fill the container. An inadequately supported valve neck during use or during transportation may also adversely affect the solution container or the associated processor.

SUMMARY OF THE INVENTION

The present invention provides for a frame having interlocking members that is adapted to support a chemical package that includes at least one solution container. The system and the design of the container of the present invention permits the container to collapse in such a way so as to not trap solution.

The frame of the system of the present invention is also adapted to support and hold a valve neck of the container to control the location of the valve neck, maintain the integrity of the neck as the container is fluidly connected to an associated processor, and prevent the valve neck from collapsing as the container is filled.

The package system of the present invention further eliminates the need for other package or container components, permits shorter assembly time, and provides protection against damage if the container or package is dropped.

The present invention therefore relates to a frame for a processing solution container that comprises a first member having a first side, with the first side having at least one first interlocking section and at least one first curved section. The at least one first curved section is sized to surround a first portion of a valve neck of an associated solution container when the first member is located on the associated container. The frame further comprises a second member that includes a second side. The second side has at least one second interlocking section and at least one second curved section. The at least one second curved section is sized to surround a second portion of the valve neck of the associated solution container when the second member is located on the associated container, such that when the first and second members are located on the associated container, the first interlocking section cooperates with the second interlocking section to lock the first member and the second member together, and the first and second curved sections respectively surround the first and second portions of the valve neck of the associated solution container.

The present invention further relates to a method of assembling a processing solution container package for association with a processor. The method comprises the steps of placing a first member on a surface of a solution container having a valve neck thereon, such that a first curved section of the first member surrounds a first portion of the valve neck; placing a second member on the surface of the solution container, such that a second curved section of the second member surrounds a second portion of the valve neck which is not surrounded by the first curved section of the first member to maintain the valve neck in an operating position, and interlocking the first member to the second member by way of interlocking sections provided on the first and second members.

The present invention further relates to a photofinishing solution container package system that comprises at least one solution container adapted to hold processing solution therein, with the solution container having at least one crown shaped surface and a valve neck for a passage of solution extending from the crown shaped surface, and a frame comprising first and second interlocking members and adapted to be located on the crown shaped surface. The first interlocking member comprises a first curved section that surrounds a first portion of the valve neck, and the second interlocking member comprises a second curved section that surrounds a second portion of the valve neck, to maintain the valve neck in an operating position when the frame is located on the crown shaped surface of the solution container.

The present invention further relates to a method of supplying processing solution to a processor that comprises the steps of placing a first member on a surface of a solution container having a valve neck which extends therefrom, such that a first curved section of the first member surrounds a first portion of the valve neck; placing a second member on the surface of the solution container, such that a second curved section of the second member surrounds a second portion of the valve neck which is not surrounded by the first curved section of the first member to maintain the valve neck in an operating position; interlocking the first member to the second member by way of interlocking sections provided on the first and second members; and fluidly connecting the solution container to a processor to permit a supply of processing solution from the solution container to the processor.

The present invention further relates to a frame for a processing solution container, which comprises an opening that is sized to surround a stem of a valve neck of an associated solution container when the frame is located on the associated container to support the valve neck in an operating position.

DETAILED DESCRIPTION OF THE INVENTION

Figure 1:
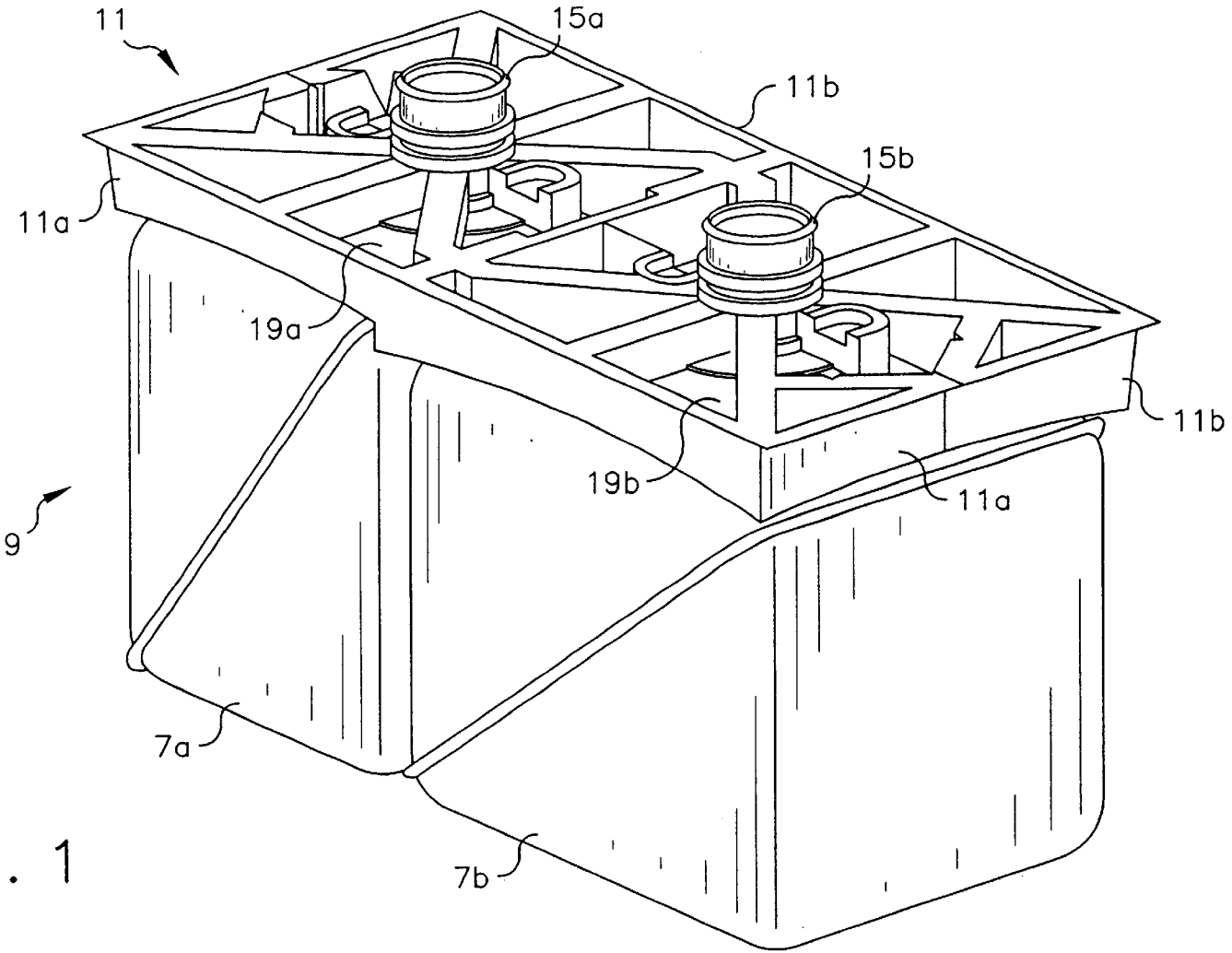
FIG. 1 illustrates a solution container package system in accordance with the present invention, including a support frame accommodated on solution containers.

Referring now to the drawings, wherein like reference numerals represent identical or corresponding parts throughout the several views, FIG. 1 illustrates a photofinishing solution container package system 9 in accordance with the present invention. As shown in FIG. 1, photofinishing solution container package system 9 includes a first container 7*a* having a first valve neck 15*a* extending from a surface 19*a*, and a second container 7*b* having a second valve neck 15*b* extending from a surface 19*b*. Valve necks 15*a* and 15*b* can be any one of a variety of valve systems as described in, for example, U.S. Pat. Nos. 5,996,653, 5,878,798, 6012,606, 6,079,444, and 5,694,991. Solution containers 7*a* and 7*b* can be of a known material and preferably made of a flexible material that is compatible with the processing solution normally used in photographic processing applications, such as for example, bleach solution, fixing solution, developing solution, etc.

Package system 9 further includes a frame 11 that comprises a first interlocking member 11*a* and a second interlocking member 11*b* that are adapted to be connected or interlocked to each other. Frame 11 is preferably made of at least one of a pulp, fiberboard, corrugated, plastic, resin, rigid, semi-rigid, pliable or foam material to provide proper support for containers 7*a*, 7*b*, and also to provide protection for containers 7*a*, 7*b* in the event that the containers or the package system are dropped. Although the example illustrated in FIG. 1 shows two containers 7*a*, 7*b* supported by frame 11, or frame 11 being accommodated on top of two containers, the present invention is not limited thereto. More specifically, frame 11 can be of any length or width and designed to accommodate any number of containers depending on where the package is to be used and the volume of processing solution desired.

Figure 2:
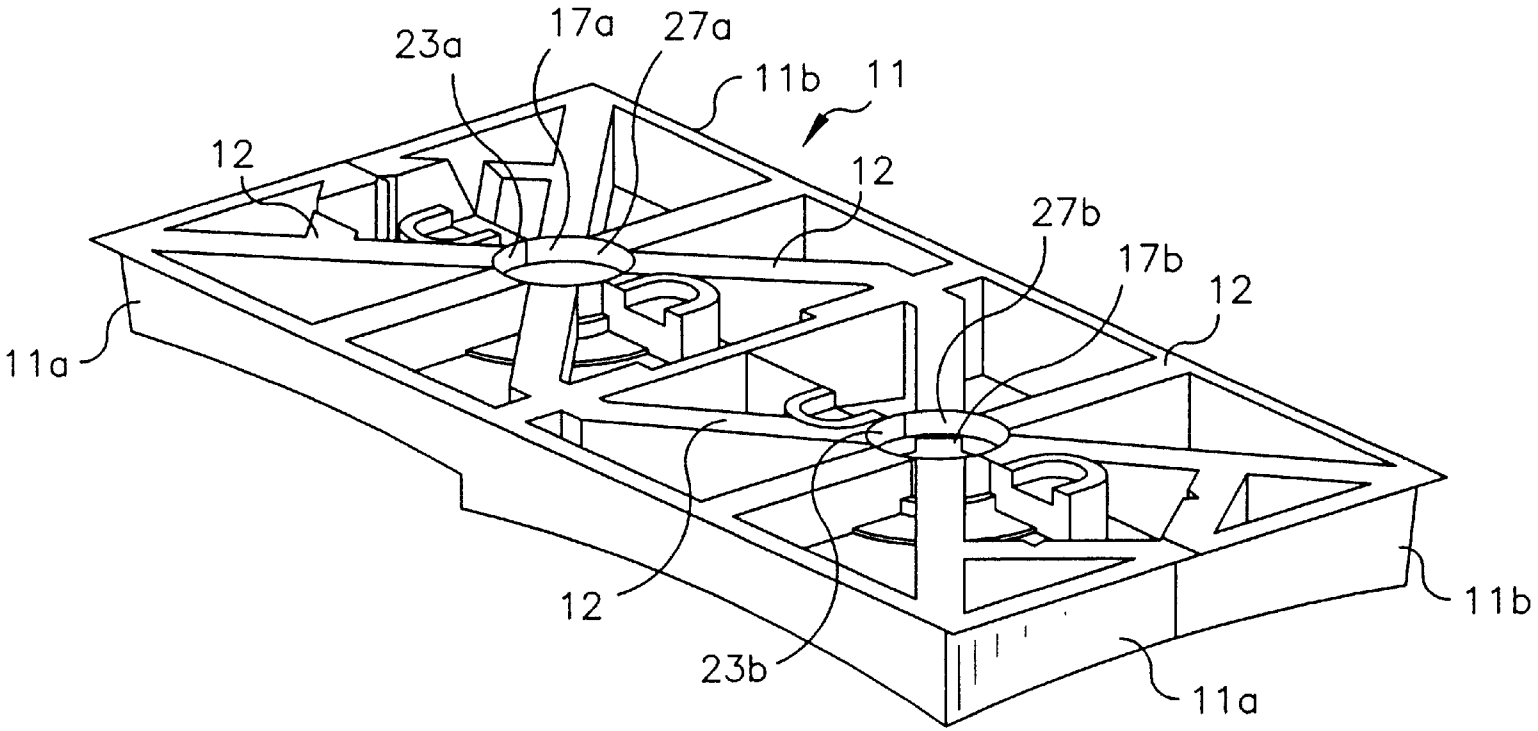
FIG. 2 is an isolated view of the frame of FIG. 1.

FIG. 2 is an isolated view of frame 11. As illustrated more clearly in FIG. 2, when first member 11*a* is interlocked with second member 11*b*, two through holes 17*a*, 17*b* are defined. Through holes 17*a*, 17*b* are designed so as to tightly fit around valve necks 15*a*, 15*b* and more specifically around respective stems 100*a*, 100*b* (see FIG. 3B) of valve necks 15*a*, 15*b* as illustrated in FIG. 1. This helps support the valve necks i.e., maintain valve necks 15*a*, 15*b* in the position shown in FIG. 1, which can be described as a working position, an operating position or an extended non-collapse position. This extended non-collapse position of the valve necks further facilitates the filling of the containers. As shown in FIG. 2, in order to add rigidity while achieving a lower overall weight, frame 11 can be comprised of a plurality of cross members 12.

Figure 3A:
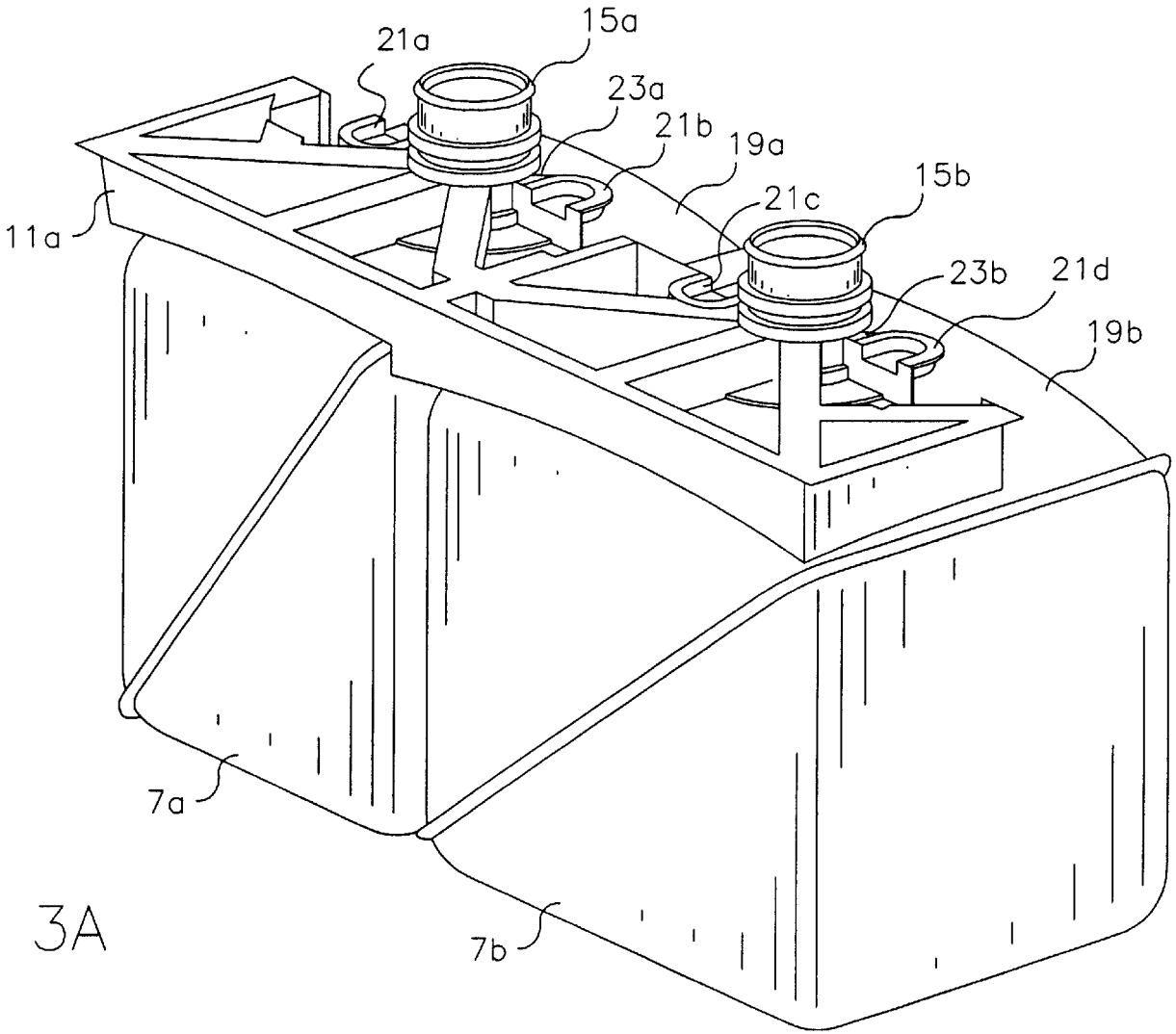
FIG. 3A illustrates the solution container package system in accordance with the present invention, wherein one of the interlocking members of the frame is accommodated or located on the containers.
Figure 3B:
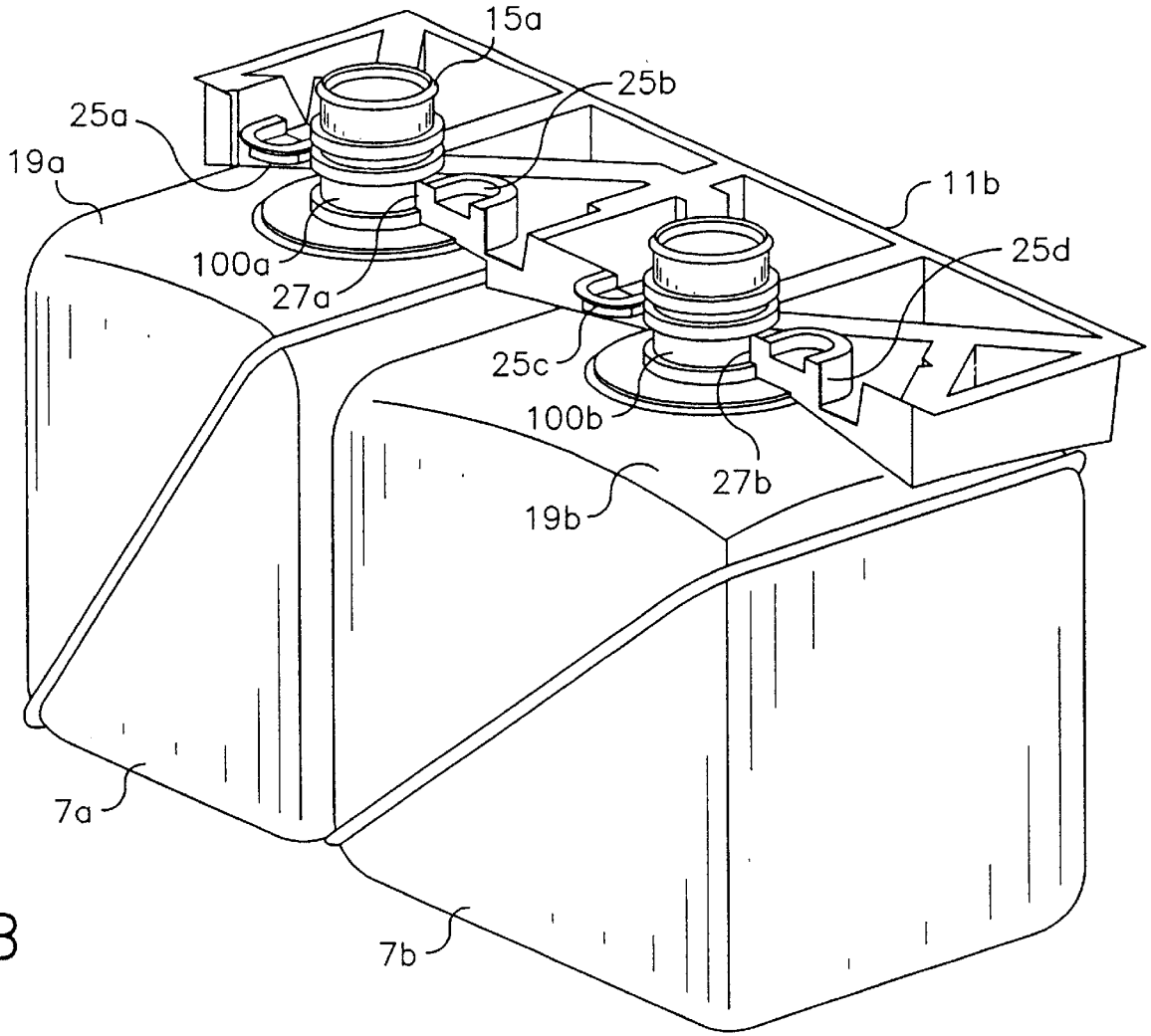
FIG. 3B is a view similar to FIG. 3A showing the other of the interlocking members of the frame accommodated on the solution containers.

With reference to FIGS. 3A and 3B, an assembly of a container package system in accordance with the present invention is illustrated. More specifically, as is illustrated in FIG. 3A, during assembly, first member 11*a* of frame 11 is provided on each of containers 7*a*, 7*b* as shown so as to extend across surfaces 19*a*, 19*b* of each of containers 7*a*, 7*b*. As shown in FIG. 3A, first member 11*a* includes a first side having locking members or sections 21*a*, 21*b*, 21*c*, 21*d*. The first side of first member 11*a* further includes curved sections 23*a*, 23*b* which match the curvature of stems 100*a*, 100*b* of respective valve necks 15*a*, 15*b*. Therefore, when first member 11*a* is placed on containers 7*a*, 7*b*, first member 11*a* is accommodated on surfaces 19*a*, 19*b* of each of containers 7*a*, 7*b* from which valve necks 15*a*, 15*b* extend. During assembly, first member 11*a* is basically accommodated on surfaces 19*a*, 19*b* and slid so that curve sections 23*a*, 23*b* surround a first portion of valve necks 15*a*, 15*b* and more specifically, a first portion of the stems of valve necks 15*a*, 15*b*. This arrangement helps maintain valve necks 15*a*, 15*b* in an operating position or an extended non-collapsed position so as to prevent a collapse of each of valve necks 15*a*, 15*b* in a direction toward surfaces 19*a*, 19*b* of containers 7*a*, 7*b*.

Thereafter, as illustrated in FIG. 3B, second member 11*b* is accommodated on surfaces 19*a*, 19*b*. For clarification purposes, FIG. 3B only shows second member 11*b* of frame 11. Second member 11*b* includes a side having interlocking members or sections 25*a*, 25*b*, 25*c*, 25*d*. This side of second member 11*b* also includes a first curved section 27*a* and a second curved section 27*b*. Curved sections 27*a*, 27*b* are illustrated in more detail in FIG. 2. Like curved sections 23*a*, 23*b* of first member 11*a*, curved sections 27*a*, 27*b* are designed to match the curvature of the stems of valve necks 15*a*, 15*b*, such that when frame member 11*b* is accommodated on surface 19*a*, 19*b* of containers 7*a*, 7*b*, the first and second curved sections 27*a*, 27*b* surround a portion of the valve necks 15*a*, 15*b*, and more particularly a portion of the stems of valve necks 15*a*, 15*b* which is not surrounded by curved sections 23*a*, 23*b*.

Further, when first and second members 11*a*, 11*b* are locked or connected together on surfaces 19*a*, 19*b* of containers 7*a*, 7*b*, interlocking section 25*a* cooperates with interlocking section 21*a*, interlocking section 25*b* cooperates with interlocking section 21*b*, interlocking section 25*c* cooperates with interlocking sections 21*c*, and interlocking section 25*d* cooperates with interlocking section 21*d*. Therefore, first and second members 11*a*, 11*b* will be locked together and valve necks 15*a*, 15*b* will be maintained in an operating or an extended non-collapse position when frame 11 is accommodated or located on surfaces 19*a*, 19*b* of containers 7*a*, 7*b* as illustrated in FIG. 1.

In a further feature of containers 7*a*, 7*b* as well as frame 11, surfaces 19*a*, 19*b* from which valve necks 15*a*, 15*b* respectively extend are preferably crowned or crown shaped, and maintain their crown shape when the containers are inverted for the purpose of draining solution therefrom.

In order to accommodate for the crown shape of surfaces 19*a*, 19*b*, the lower surfaces of first and second members 11*a*, 11*b* are curved so as to match the curvature of crowned surfaces 19*a*, 19*b*.

In a preferred feature of the present invention, containers 7*a*, 7*b* of package system 9 are fluidly connected to a processor and drained while held in an inverted position. Also, containers 7*a*, 7*b* are made of a flexible material which is compatible with the solution held in the respective container and collapses as the solution is drained from the respective container. An advantage of having a crowned or crown shaped surface 19*a*, 19*b* relates to the fact that crown shaped surfaces 19*a*, 19*b*, as well as valve necks 15*a*, 15*b* when inverted will define a bottom surface of containers 7*a*, 7*b*. Since crowned surfaces 19*a*, 19*b* maintain their shape during drainage, creases in the inside portion of surfaces 19*a*, 19*b* will not be formed, and therefore, there will be no trapping or holding of solution on the inside portion of surfaces 19*a*, 19*b*. This promotes a drainage of substantially all of the solution within containers 7*a*, 7*b* when containers 7*a*, 7*b* are fluidly connected to a processor.

In a further feature of the invention, the utilization of curved sections 23*a*, 23*b*, 27*a*, 27*b* facilitates assembly in that it helps maintain the valve necks 15*a*, 15*b* in an operating position or an extended non-collapsed position. This facilitates use of containers 7*a*, 7*b* and package system 9, since during use in an inverted position, the valve necks will be steadily held and will not collapse.

As indicated above, frame 11 is preferably made of a fiberboard, corrugated, pulp or resin material. This lends stability to package system 9, and at the same time provides protection in the event that the package system 9 is accidentally dropped.

A further feature of package system 9 having frame 11 in accordance with the present invention, is that during a filling process where containers 7*a*, 7*b* are filled with solution, frame 11 including the curved sections 23*a*, 23*b*, 27*a*, 27*b* noted above maintain the neck in an extended non-collapse position. This prevents valve necks 15*a*, 15*b* from collapsing toward surface 19*a*, 19*b* during the filling of the containers with solution. In the event that you have a flexible container, it further prevents the container and valve necks from collapsing.

Figure 4:
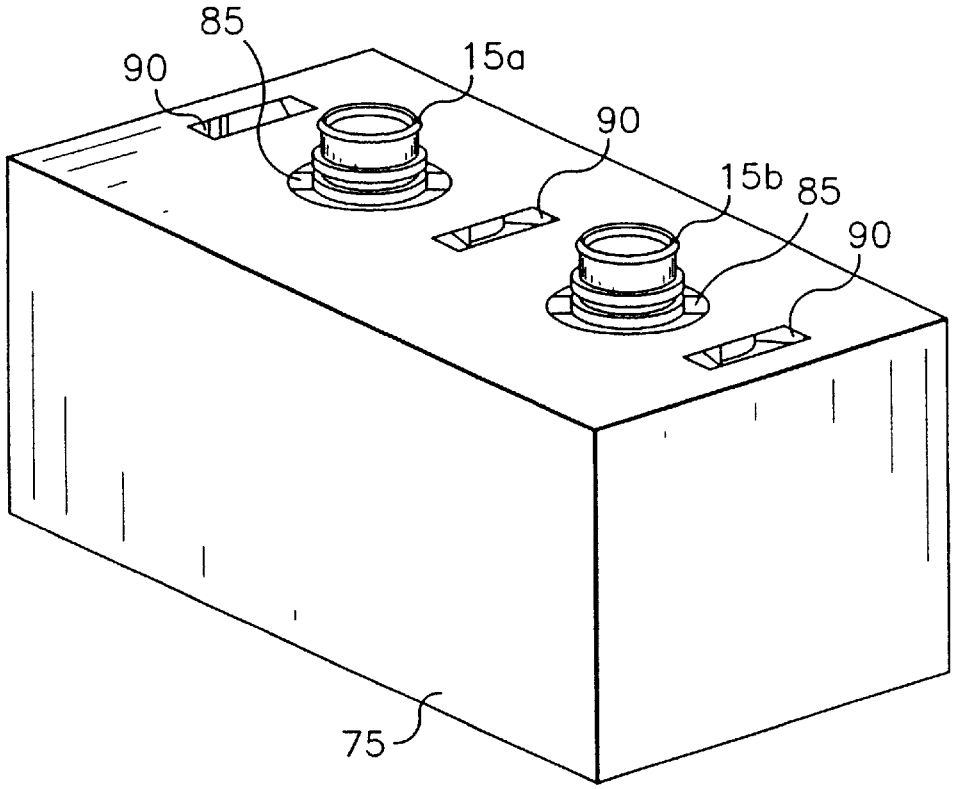
FIG. 4 is a view of the solution container package system in accordance with the present invention, having an outer enclosure surrounding the containers and frame.

In a preferred feature of the present invention, package system 9 is provided within an outer enclosure 75 as shown in FIG. 4. Outer enclosure 75 is preferably made of a rigid material. This is especially beneficial when containers 7*a*, 7*b* are made of flexible material since it protects containers 7*a*, 7*b* from damage during transportation and during use. In a further feature, outer enclosure 75 could be made of a rigid material which is compatible with solutions in the container so as to hold the solution therein in the event of a leak from the containers.

Outer enclosure 75 is preferably sized to hold each of the containers of package system 9 and frame 11 accommodated on the containers therein. Outer enclosure 75 could also include openings 85 which permit the passage of valve necks 15*a*, 15*b* in a sealed manner, and location or orientation keys 90 which facilitates the integration of package system 9 with a processor.

Figure 5:
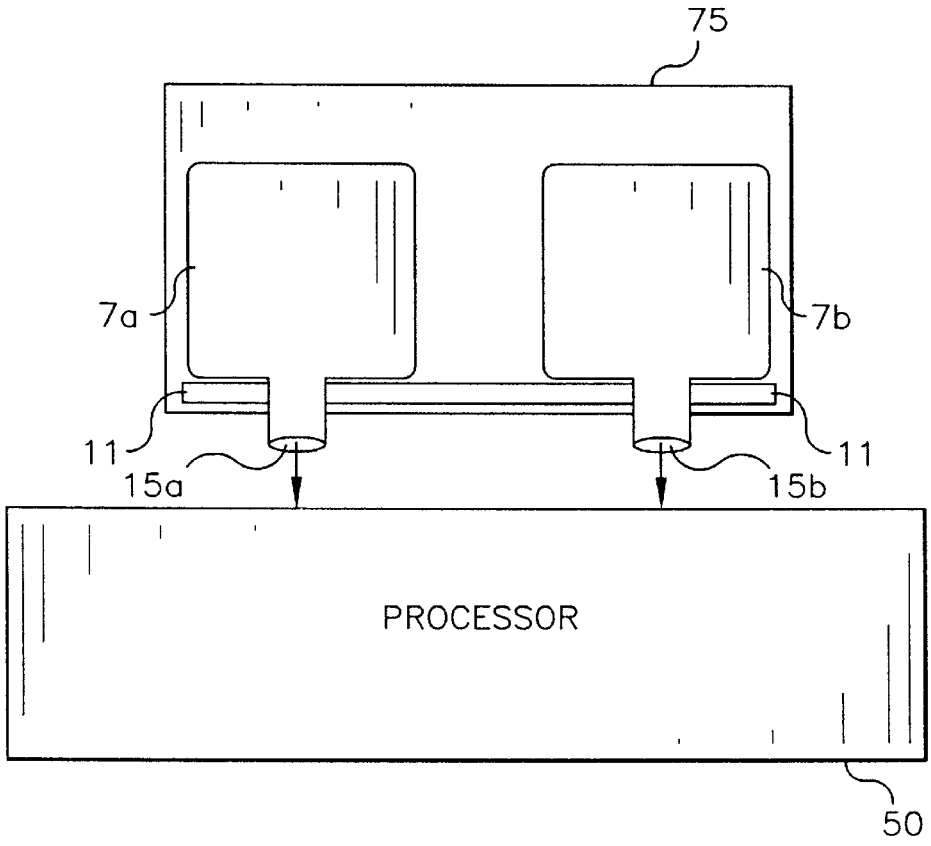
FIG. 5 is a schematic illustration of the solution container package system in accordance with the present invention in association with a processor.

FIG. 5 shows a schematic illustration of a photographic processing arrangement utilizing a package system 9 in accordance with the present invention in combination with a processor 50. Processor 50 can be a known processor which includes different processing stations or tanks which include, for example, developer solution, bleach solution, fixing solution, etc. In processor 50, photographic material is inserted and processed in a known manner by being conveyed through each of the processing tanks or sections of the processor. Processor 50 can be a known mini-lab or wholesale processing arrangement.

During use, package system 9 which can be comprised of containers 7*a*, 7*b*, frame 11 mounted thereon, and outer enclosure 75 is placed in an inverted position and fluidly connected by way of, for example, known fluid connection valves or probes to processor 50. While in the inverted position, package system 9 can be placed on a support next to the processor or some other kind of mechanism which places package system 9 in a position where it can feed solution to the processor. FIG. 5 again schematically illustrates the cooperation between package system 9 and processor 50. It is noted that package system 9 does not have to be positioned over processor 50 as shown in FIG. 5 and can be placed adjacent thereto or on the same level thereto so long as valve necks 15*a*, 15*b* are fluidly connected to processor 50 and solution is drained from the containers. As already described, as solution is drained from each of containers 7*a*, 7*b*, the containers will collapse in a direction of solution feed or drain. Frame 11 helps to maintain valve necks 15*a*, 15*b* stable, and further prevents valve necks 15*a*, 15*b* from collapsing back towards the container. Further, by having a crown shaped surface on the containers which maintains its shape during drainage, no creases will be created on an inner portion of the crown shaped surface for trapping fluid. This promotes the drainage of substantially all of the solution from each of the containers.

The invention has been described in detail with particular reference to certain preferred embodiments thereof, but it will be understood that variations and modifications can be effected within the spirit and scope of the invention.

What is claimed is:

1. A method of supplying processing solution to a processor, the method comprising the steps of:

placing a first member on a top surface of a solution container having a valve neck which extends therefrom, such that the first member is supported by the solution container and a first curved section of the first member surrounds a first portion of the valve neck;

placing a second member on the top surface of the solution container, such that the second member is supported by the solution container and a second curved section of the second member surrounds a second portion of the valve neck which is not surrounded by the first curved section of the first member to hold the valve neck in an operating position;

interlocking the first member to the second member by way of interlocking sections provided on said first and second members; and fluidly connecting said solution container to a processor to permit a supply of processing solution from the solution container to the processor.

2. A method according to claim 1, wherein said solution container is made of a flexible material.

3. A method according to claim 2, wherein said fluidly connecting step comprises:

inverting the solution container having the interlocked first and second members thereon, such that the valve neck extends in a downward direction from the surface of the solution container and the solution container is supported by the interlocked first and second members, wherein the supply of solution from the container to the processor causes the flexible solution container to collapse in a direction of the supply of solution.

4. A method according to claim 1, wherein said operating position of said valve neck is an extended non-collapsed position.

* * * * *